US005309846A

United States Patent [19]

Peterson

[11] Patent Number: 5,309,846

[45] Date of Patent: May 10, 1994

[54] TEMPORARY GRASS PLAYING FIELD

[75] Inventor: Douglas L. Peterson, Lake Orion, Mich.

[73] Assignee: 3-Dimensional Services, Rochester, Mich.

[21] Appl. No.: 999,118

[22] Filed: Dec. 31, 1992

[51] Int. Cl.[5] ..... B65D 19/00

[52] U.S. Cl. ..... 108/51.1; 472/92

[58] Field of Search ..... 108/51.1, 56.1, 55.1, 108/55.3, 53.1, 53.3, 53.5, 90, 161; 472/92

[56] References Cited

U.S. PATENT DOCUMENTS

| | | | |
|---|---|---|---|
| 3,107,690 | 6/1965 | DesBois | 108/51.1 |
| 3,421,679 | 1/1969 | Goldman | 108/161 X |
| 3,541,977 | 11/1970 | Waldman | 108/53.1 |
| 3,603,273 | 9/1971 | Riffe | 108/51.1 |
| 4,007,694 | 2/1977 | Fowler et al. | 108/55.1 |

FOREIGN PATENT DOCUMENTS

| | | | |
|---|---|---|---|
| 2612793 | 9/1988 | France | 472/92 |
| 1208933 | 10/1970 | United Kingdom | 472/92 |
| 2138690 | 10/1984 | United Kingdom | 472/92 |

*Primary Examiner*—Jose V. Chen

*Attorney, Agent, or Firm*—Gifford, Groh, Sprinkle, Patmore and Anderson

[57] ABSTRACT

A system is disclosed for creating a temporary grass playing field. The system includes a plurality of substantially identical pallets, each pallet having a base with a top surface and a bottom surface. The pallets are polygonal in shape and are adapted to abut against each other to form the playing field. Reinforcing brackets are secured to the bottom surface of the base to elevate the base above a ground support surface by a distance sufficient to enable the fork of a forklift truck to be inserted under the base and the lift the pallet. Grass sod corresponding in shape to the base is then supported on the top surface of the base. This grass forms the temporary grass playing field when the pallets are nested together so that the sides of the pallets abut against each other.

7 Claims, 2 Drawing Sheets

TEMPORARY GRASS PLAYING FIELD

BACKGROUND OF THE INVENTION

I. Field of the Invention

The present invention relates to a system for creating a temporary grass playing field.

II. Description of the Prior Art

Many playing fields of the type used for football fields are conventionally constructed of artifical grass. Such artificial grass is advantageous in that it requires little maintenance in order to maintain the field in playing condition. Furthermore, it has previously been difficult to grow natural grass in closed stadiums.

Although artificial grass is virtually maintenance free as contrasted to natural grass, artifical grass does not exhibit the natural resiliency and shock absorbing characteristics of natural grass. Because of this, certain sports, such as soccer, cannot be safely played by athletes on artificial grass but must, instead, be played on natural grass. Conversely, other sports, such as football, can be played safely on artificial grass.

There are no previous systems known which are capable of temporarily converting an artificial grass playing field into a natural playing field. Such a system, however, would be advantageous to allow different sports, such as soccer, to be played on football fields in the off season which are covered with artificial grass.

SUMMARY OF THE PRESENT INVENTION

The present invention provides a system for creating a temporary grass playing field which overcomes the above mentioned disadvantages.

In brief, the system of the present invention comprises a plurality of substantially identical pallets, each pallet having a base with a top surface and a bottom surface. Each pallet, furthermore, is polygonal in shape and is either hexagonal (six sides) or pentagonal (five sides).

At least one and preferably several reinforcing brackets are secured to the bottom surface of the base thereby elevating the base above a ground support surface by a predetermined distance. This distance is preferably sufficient to enable the forks of a forklift truck to be inserted underneath the base of the pallet and to be transported as desired to and from the playing field by the forklift truck.

An upwardly extending sidewall is secured to and around the entire outer periphery of the base. An edge member is then detachably secured to the upper side of the sidewall and, in doing so, effectively extends the heighth of the sidewall to approximately four inches.

With the edge member secured to the sidewall, the top surface of the pallet base is filled with dirt up to the top of the edge member. Grass is then grown in the dirt in the conventional fashion.

After the grass is grown, when it is desired to create the temporary playing field, the forklift truck transports the pallet with its now grown grass to the desired location. The pallets are positioned in edge to edge abutment with each other until the pallets completely cover the playing field. Thereafter, the edge members are removed.

When it is desired to return the playing field to the artificial grass, the pallets are individually removed by forklift truck, the edge members replaced on each pallet and the pallets stored in an appropriate storage location.

BRIEF DESCRIPTION OF THE DRAWING

A better understanding of the present invention will be had upon reference to the following detailed description when read in conjunction with the accompanying drawing, wherein: like reference characters refer to like parts throughout the several views, and in which.

DETAILED DESCRIPTION OF PREFERRED EMBODIMENTS OF THE PRESENT INVENTION

Figure 1:
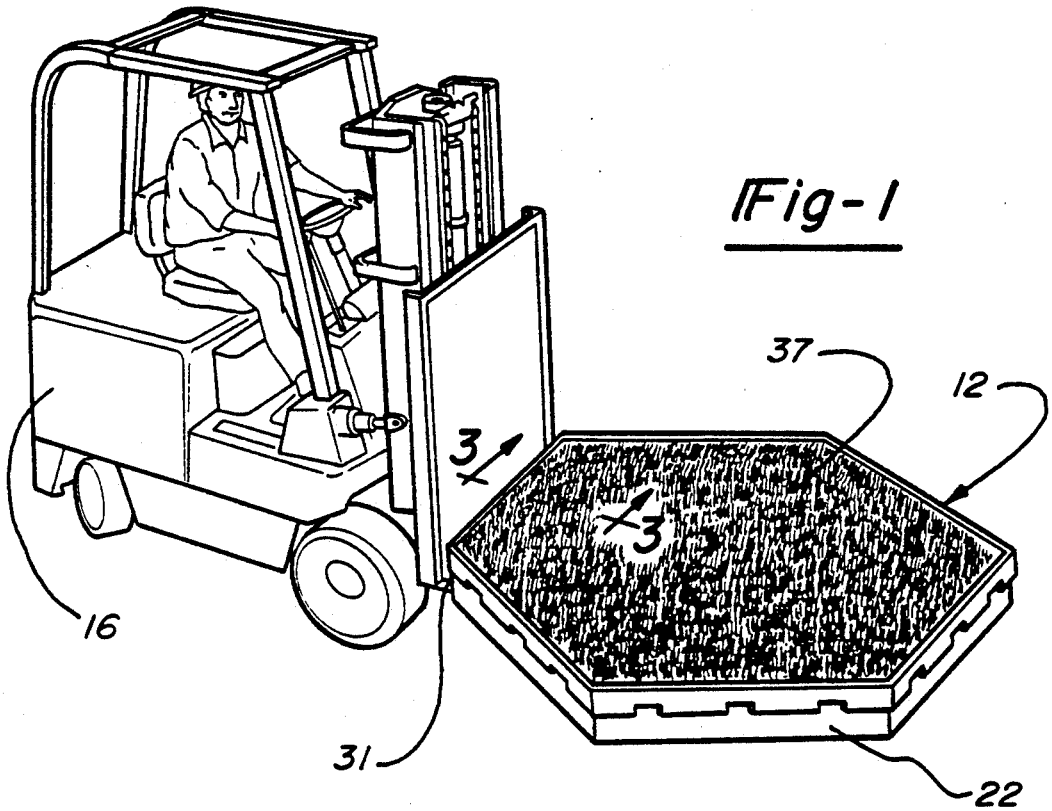
FIG. 1 is an elevational view illustrating one pallet being transported by a forklift truck.
Figure 5:
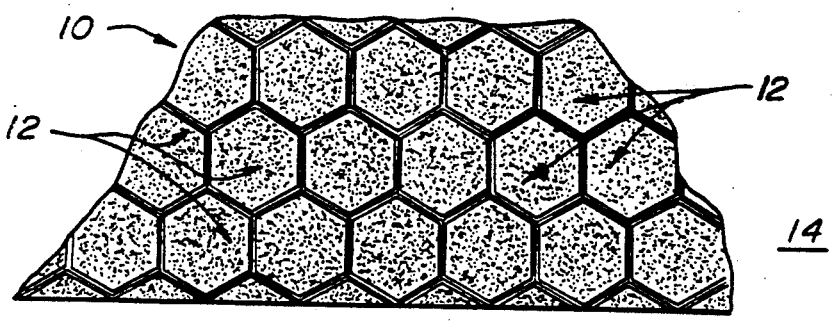
FIG. 5 is a top view illustrating a playing field.

With reference first to FIGS. 1 and 5, a preferred embodiment of the system for creating a temporary grass field 10 of the present invention is thereshown as will be subsequently described in greater detail, a plurality of hexagonally shaped pallets 12, each containing grass sod corresponding in shape to the pallet are positioned on a playing field 14. Any conventional means, such as a forklift truck 16 (FIG. 1) are used to move the pellets 12 both into and out of position as desired.

Figure 2:
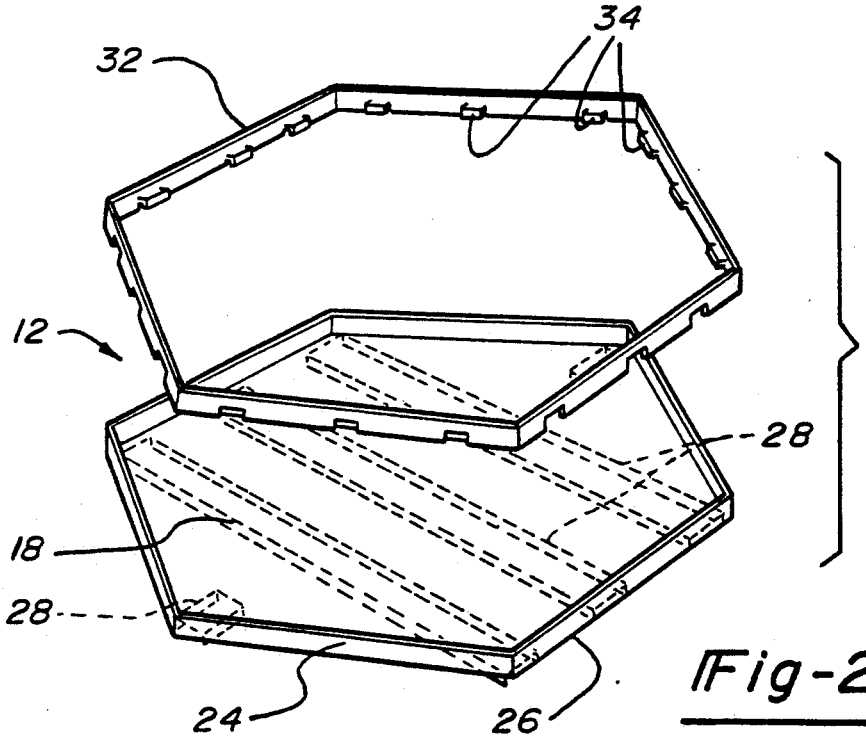
FIG. 2 is an exploded view of one pallet of the preferred embodiment of the invention.
Figure 3:
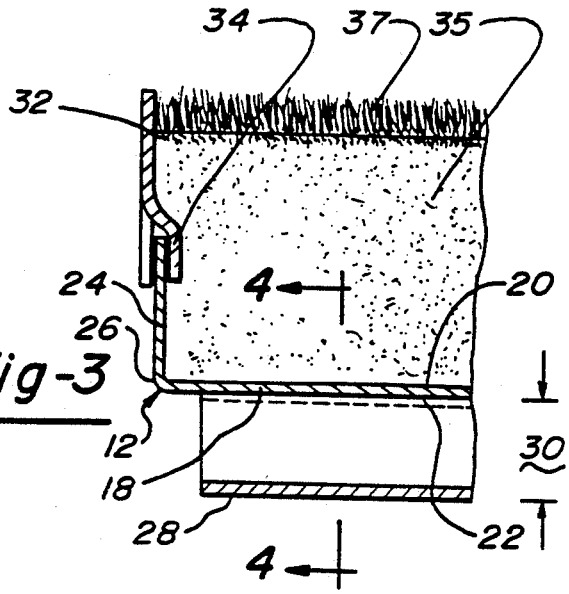
FIG. 3 is a view taken along line 3—3 in FIG. 1 and enlarged for clarity.
Figure 4:
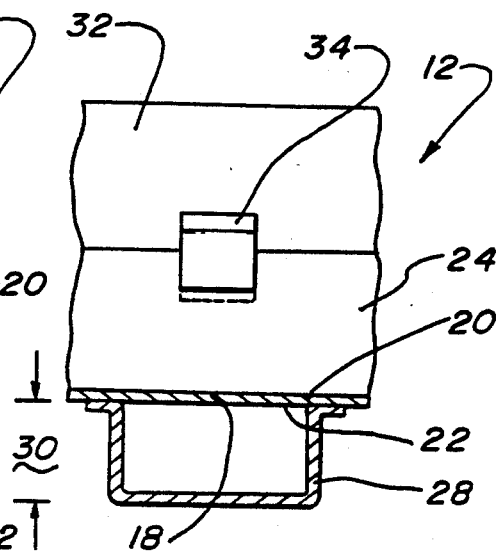
FIG. 4 is a view taken along line 4—4 in FIG. 3.

With reference now to FIGS. 2–4, one pallet 12 is thereshown in greater detail and comprises a base 18 which is hexagonal in shape. The base 18 has both a top surface 20 and a bottom surface 22. A thin walled sidewall 24 extends upwardly from the top surface 20 of the base 18 around the entire outer periphery 26 of the base 18. As best shown in FIG. 3, the plane of the sidewall 24 is substantially perpendicular to the plane of the base 18.

With reference still to FIGS. 2–4, at least one, and preferably several reinforcing brackets 28 are secured to the bottom surface 22 of the base 18. These reinforcing brackets 28 not only rigidify the overall pallet 12, but also elevate the bottom surface of the pallet 22 by a predetermined distance 30. This predetermined distance 30, furthermore, is sufficient to enable the forks 31 (FIG. 1) to be inserted under the pallet base 22 so that, with the forks 31 elevated, the forklift truck 16 can be used to move the pallet 12.

A thin walled, planar edge member 32 is detachably secured to an upper end of the sidewall 24 so that the edge member 32 effectively extends the overall height of the sidewall 24. Although any means can be used to detachably secure the edge member 32 to the sidewall 24, preferably the edge member 32 includes a plurality of tabs 34 which are formed from a bottom edge of the edge member 32. These tabs 34 lie generally in a plane parallel but spaced from the plane of the edge member 32. Thus, with the edge member 32 positioned on top of the sidewall 34, a portion of the upper edge of the sidewall 24 is entrapped between the locking tabs 34 and the edge member 32. Preferably two separate edge members 32 are secured to each pallet 12.

As best shown in FIG. 3 with the edge members 32 detachably secured to the sidewall 24 in the previously described fashion, the heighth of the sidewall 24 together with the edge member 32 is approximately four inches. The top surface 20 of the base 18 is then filled with dirt 35 up to the top of the edge member 32. Grass 37 is then grown in each pallet 12.

After the grass 37 is grown and when it is desired to create the temporary grass playing field, the forklift truck 16 (FIG. 1) is utilized to move the pallets 12 and arrange the pallets 12 so that each edge of each pallet 12 (except for the outer pallets 12) abuts against an edge of an adjacent pallet as shown in FIG. 5. Thus, each pallet 12 abuts against six different pallets 12 throughout the playing field.

Figure 6:
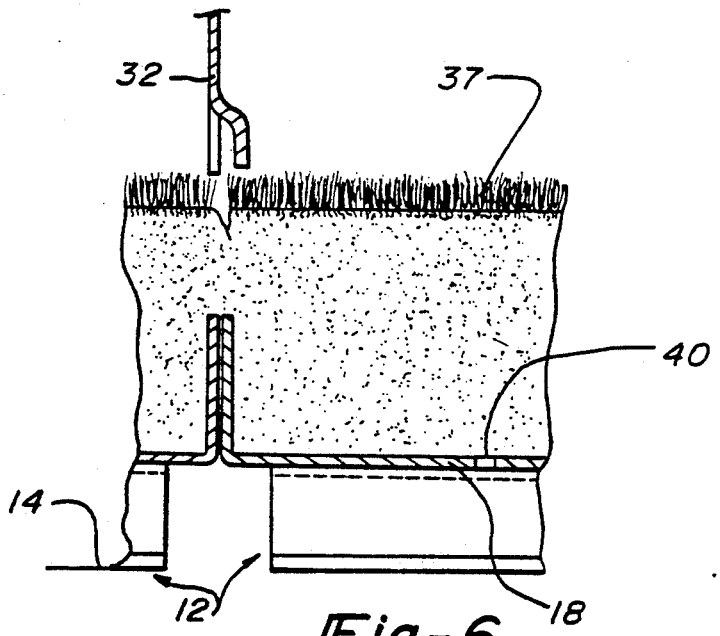
FIG. 6 is a view similar to FIG. 4.

Referring now to FIG. 6 after the pallets 12 are positioned on a playing field, the edge members 32 are removed from the pallets 12 and the grass 37 from adjacent pallets are allowed to knit together for a predetermined period of time, for example ten days. During this period, the grass in the pellets 12 is watered, mowed, and otherwise maintained in the conventional fashion. Furthermore, drainage holes 40 are provided in the pellets 12 for water drainage.

After the grass in adjacent pallets 12 knits together, the pallets form a playing field which can be used in the conventional fashion. When disassembly of the grass playing field is desired, the forklift truck 16 is used to remove the individual pallets 12 to a storage location. At this time, the edge members 32 are replaced on each pallet 12.

Preferably the entire pallet is constructed of high strength metal. It has been found that 11 gauge HSLA, SAE 1395 is adequate for construction of all components of the pallet 12. Such metal is also corrosion resistant to water.

A primary advantage of utilizing the hexagonal shape for the pallet 12 is that any force exerted on the pallets in any direction is absorbed by at least two, and usually three adjacent pallets. As such, movement of the pellet 12 during play on the field is virtually non-existent. Furthermore, the hexagonal shape of the pallets automatically compensates for manufacturing tolerances.

Having described our invention, however, many modifications thereto will become apparent to those skilled in the art to which it pertains without deviation from the spirit of the invention as defined by the scope of the appended claims.

I claim:

1. A system for creating a temporary grass playing field comprising:

a plurality of substantially identical pallets, each pallet having a base with a top surface and a bottom surface, each of said pallet bases having a regular hexagonal shape, means secured to said bottom surface of each said pallet base for elevating said pallet base a predetermined distance above a ground support surface, grass sod corresponding in shape to said pallet base supported on said top surface of said pallet base, a sidewall extending upwardly from said top surface of said base, said sidewall extending around substantially the entire outer periphery of said base, means for enabling grass on adjacent pallets to knit together comprising an elongated edge member and means for detachably securing said edge member to an upper edge of said sidewall so that said edge member extends upwardly form said sidewall.

2. The invention as defined in claim 1 wherein said means for detachably securing said edge member to said sidewall comprises a plurality of tabs disposed around a bottom of said edge member, said tabs lying in a plane parallel to and spaced from said edge member, said tabs adapted to fit over the top of said sidewall so that a portion of the sidewall is entrapped between said tabs and said sidewall.

3. The invention as defined in claim 1 wherein said predetermined distance is sufficient to receive the forks of a fork lift truck.

4. The invention as defined in claim 1 and comprising at least one drainage hole formed through said base.

5. The invention as defined in claim 1 wherein said base is constructed of corrosion resistant metal.

6. The invention as defined in claim 1 wherein said elevating means comprises at least one support bracket secured to said bottom surface of said base.

7. The invention as defined in claim 6 wherein said support bracket is elongated.

* * * * *

UNITED STATES PATENT AND TRADEMARK OFFICE

CERTIFICATE OF CORRECTION

PATENT NO. : 5,309,846

DATED : May 10, 1994

INVENTOR(S) : Douglas L. Peterson

It is certified that error appears in the above-indentified patent and that said Letters Patent is hereby corrected as shown below:

Column 4, line 21, delete "form" and insert --from--.

Signed and Sealed this

Twenty-seventh Day of September, 1994

*Attest:*

Bruce Lehman

BRUCE LEHMAN

*Attesting Officer*

*Commissioner of Patents and Trademarks*